US007753128B2

(12) United States Patent
Moen

(10) Patent No.: US 7,753,128 B2
(45) Date of Patent: Jul. 13, 2010

(54) METHOD AND SYSTEM FOR WELL PRODUCTION

(75) Inventor: Terje Moen, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/275,675

(22) Filed: Nov. 21, 2008

(65) Prior Publication Data

US 2009/0126940 A1 May 21, 2009

Related U.S. Application Data

(60) Provisional application No. 60/989,468, filed on Nov. 21, 2007.

(51) Int. Cl.
*E21B 37/00* (2006.01)

(52) U.S. Cl. ..... 166/370; 166/311; 166/299

(58) Field of Classification Search ..... 166/370, 166/311, 299

See application file for complete search history.

(56) References Cited

U.S. PATENT DOCUMENTS

| | | | | |
|---|---|---|---|---|
| 5,293,940 | A | 3/1994 | Hromas et al. | |
| 6,273,187 | B1 | 8/2001 | Voisin, Jr. et al. | |
| 6,315,050 | B2 | 11/2001 | Vaynshteyn et al. | |
| 6,419,023 | B1 | 7/2002 | George et al. | |
| 6,439,313 | B1 | 8/2002 | Thomeer et al. | |
| 6,945,331 | B2 | 9/2005 | Patel | |
| 6,973,970 | B2 | 12/2005 | Johnston et al. | |
| 7,419,002 | B2 * | 9/2008 | Dybevik et al. | 166/205 |
| 7,451,819 | B2 * | 11/2008 | Chang et al. | 166/299 |
| 2005/0006102 | A1 | 1/2005 | Cho | |
| 2007/0017675 | A1 | 1/2007 | Hammami et al. | |
| 2007/0044963 | A1 | 3/2007 | MacDougall | |
| 2007/0107908 | A1 | 5/2007 | Vaidya et al. | |
| 2008/0099209 | A1 | 5/2008 | Loretz et al. | |
| 2008/0105438 | A1 | 5/2008 | Jordan et al. | |
| 2008/0149345 | A1 | 6/2008 | Marya et al. | |
| 2009/0050334 | A1 | 2/2009 | Marya et al. | |

* cited by examiner

*Primary Examiner*—David J Bagnell
*Assistant Examiner*—Kipp C Wallace
(74) *Attorney, Agent, or Firm*—Rodney V. Warfford; David G. Matthews; Robert Van Someren PC

(57) ABSTRACT

Disclosed herein are methods for preparing a wellbore for production or injection. The methods may include the steps of positioning a completion longer than 300m comprising an inflow control device (ICD) having radial flow paths in the wellbore adjacent to a filtercake and determining the pressure required to lift the filtercake off of the wellbore. The radial flow paths of the ICD are designed such that when the filtercake adjacent to a downstream portion of the ICD completion is removed, the pressure drop across the first downstream part of the ICD completion is sufficient to maintain a drawdown pressure high enough such that the second upstream filtercake is also removed.

14 Claims, 2 Drawing Sheets

METHOD AND SYSTEM FOR WELL PRODUCTION

RELATED APPLICATIONS

This application claims priority to provisional U.S. Patent Application No. 60/989,468 filed on Nov. 21, 2007 and incorporated herein by reference.

BACKGROUND

Hydrocarbon fluids such as oil and natural gas are obtained from a subterranean geologic formation, referred to as a reservoir, by drilling a well that penetrates the hydrocarbon-bearing formation. When drilling the well, a viscous drilling fluid (or drill mud) with certain increased shear strength characteristics is often used to maximize removal of drill cuttings to be transported out of the well. Still, settlement of drill cutting particles must be expected. Another purpose of the drill mud is also to provide a filtercake along the wellbore to prevent fluid loss into the formation. To save rig time, a screen completion is often installed in this drilling mud. This drilling mud containing particles from the drilling phase may to some extent be removed by circulating fresh or conditioned mud into the well or be displaced by a clean completion fluid such as brine. In any case, the well bore may be covered by a filtercake. Once the well is completed, the filtercake may be removed to produce the well. To remove this filtercake, a certain differential pressure is required across the filtercake (i.e., the formation pressure on the formation side of the filtercake must be higher than the pressure on the borehole side of the filtercake to break the filtercake off of the borehole wall).

When the well is to be put on production, the drilling fluid system (including the filtercake) must flow back through the sand screens. If the screen completion becomes long (for example, in the range beyond 300 m to 500 m), it may be a challenge to remove the fluid system properly along the whole interval. Also, a certain pressure drop is required to initiate the flow of reservoir fluid. This is both (1) because of the required differential pressure to lift off the filter cake and (2) to break circulation as the drilling fluid starts flowing in various tortuous paths of the screen completion. In addition, pressure increases along the tubing in long horizontal wells makes it more difficult to achieve the needed liftoff pressure because as you move upstream in the tubing, the pressure increases. Thus the differential pressure between the formation and the tubing decreases as you move from the heel of the well to the toe of the well (also called the heel-toe effect). As explained herein, this decrease in differential pressure will contribute to the difficulty of removing the filtercake along the upstream portions of the wellbore. As the first part (typically high-permeable zones) of the well starts flowing, the required pressure may no longer be available in the remaining part of the well. Consequently, the cleanup process will in many cases stop before the whole well is cleaned up and can contribute.

Accordingly, the flow performance of long, screen-based completions may be a challenge due to problems related to well cleanup.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Figure 1:
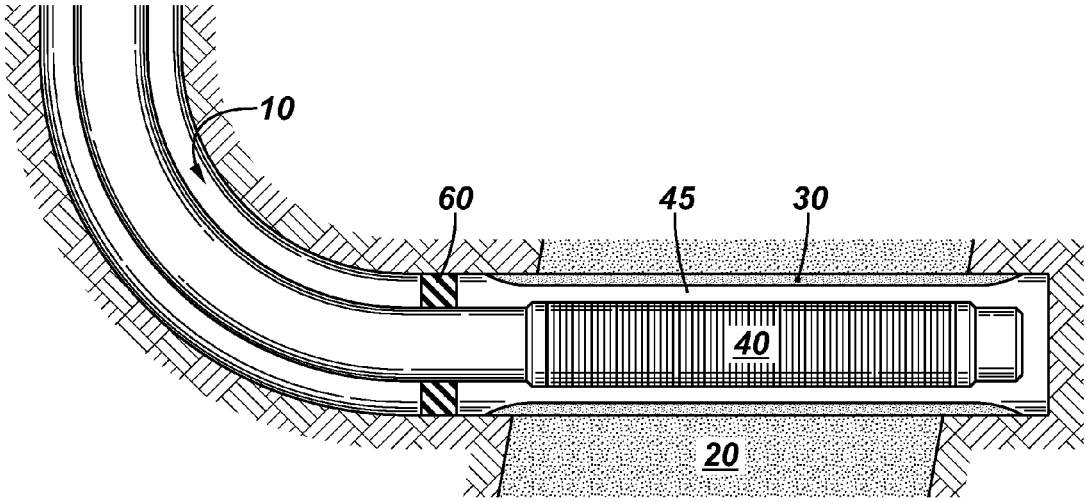
FIG. 1 is a schematic drawing of a well and completion.

With respect to FIG. 1, a lower completion 40 is run into a wellbore 10 and positioned adjacent a formation 20 that is desired to be produced. Once the lower completion 40 is positioned as desired, packers 60 may be set to isolate the annulus adjacent to the formation from the annulus above the packers 60. As an alternative to packers, the pressure drop caused by annular flow will also have a similar effect, particularly if the annulus is small. This is also the case for a partly collapsed annulus that contributes to a compartmentalization of the well. Along the wellbore wall and in the annulus 45 between the lower completion 40 and the formation 20 is a filtercake 30 comprising solids remaining downhole from the drilling operation. The term filtercake in this document is a layer of particulate solids (e.g., mud) deposited on the well bore wall and eventually partly into the formation that has the purpose of preventing or limiting the fluid invasion into the formation during the drilling and completion phase. In order to begin producing fluids from the formation 20, it is necessary to remove at least a portion of the filtercake 30 adjacent to the formation 20. In many cases, it is desirable to remove as much of filtercake 30 as possible in order to produce fluids from the formation 20 evenly along the formation 20. If only a portion of the filtercake is removed, the formation 20 will drain unevenly which may lead to undesirable consequences, such as premature water coning.

Figure 2:
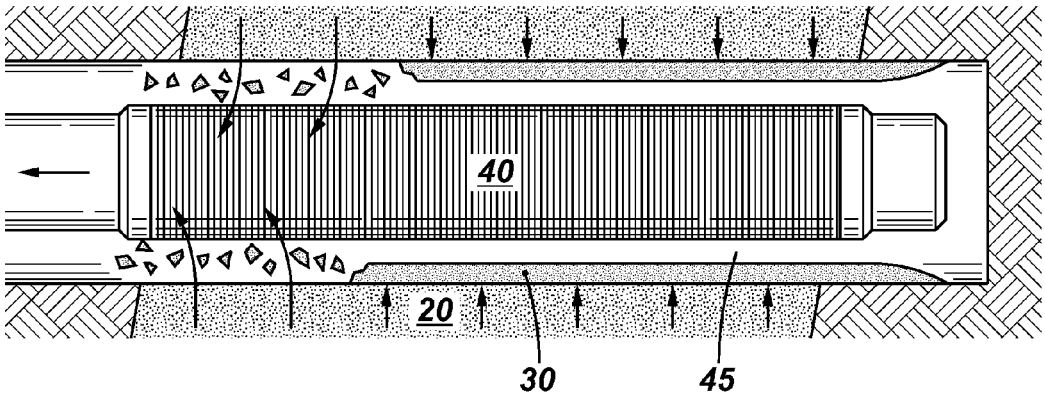
FIG. 2 is a second schematic drawing of a well and completion wherein an upstream portion of the filtercake has been broken and the formation adjacent to the broken filtercake is producing fluids.
Figure 3:
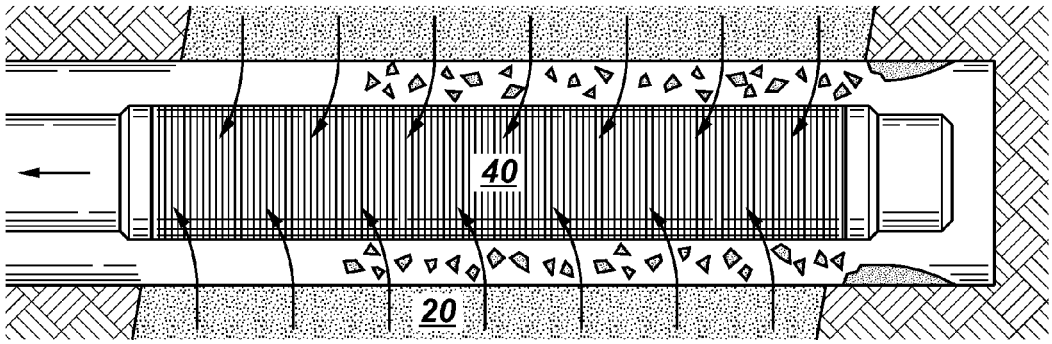
FIG. 3 is a third schematic drawing of a well and completion wherein substantially all of the filtercake is broken and the formation is producing fluids along substantially the entire length of the completion.

In order to break filtercake 30, it is necessary that the pressure drop across the filtercake (i.e., from the formation to the annulus 45 outside the lower completion 40) is above a threshold level. In practice, as is shown in FIG. 2, the pressure differential across the downstream portion of the filter cake 30, once production has started in one portion (e.g., the upstream portion) of the lower completion 40, is often less than the threshold level necessary to remove the filter cake 30. Thus, in many instances, only the formation adjacent to the downstream portion of the lower completion begins producing (shown by dark arrows). The fluids further down the lower completion 40 can not break filter cake 30 and consequently does not contribute to flow.

One way to ensure an even flow across the entire formation is the use of inflow control devices (ICD) as part of the lower completion. An exemplary ICD is shown in U.S. Pat. No. 7,419,002, incorporated herein by reference. Without the use of an inflow control device, most screen-based completions provide sufficient flow capacity over just a few joints of screened tubing. As discussed above, the inflow in the first few upstream joints has two effects. First, it increases the pressure within the tubing of the completion. Second, it decreases the formation draw down pressure in the areas adjacent to the area that is producing. This means that there is limited differential pressure across the remaining filter cake (i.e., further down into the well). Because of this limited pressure differential, the filtercake in areas downstream of the producing portion of the formation may not be broken and removed. Consequently, the downstream areas of the formation are not able to be produced. This failure to produce the downstream areas of the formation may lead to reduced overall production and premature water coning or other problems.

Two primary types of ICDs are available to the market—(1) the tube/channel type ICD (such as shown in U.S. Pat. No. 5,435,393), which provides a friction pressure drop as fluid is flowing, and (2) the nozzle-based type ICD (such as shown in U.S. Pat. No. 7,419,002), which provides a pressure drop as pressure is transferred into velocity and then absorbed downstream of the nozzle.

In general, embodiments of the present invention include a method to design a required pressure drop and a system to make it possible to apply this pressure drop to effectively clean the well of drill mud. This pressure drop is a function of the fluid system (e.g., drill mud) and the reservoir properties. The pressure drop can be determined either by calculations or practical experiments. The pressure drop through the formation is normally described by the Darcy law which may be describe as:

$\Delta pr = cr \times q$, where cr describes reservoir flow geometry, permeability and fluid viscosity and q is the flow rate The pressure drop across the ICD is given by:

$\Delta pi = ct \times q^2$ for a nozzle based ICD or a channel tube based ICD when flow is in turbulent mode and:

$\Delta pi = cla \times q$ when a channel/tube based ICD is in laminar mode, where ct is a constant given by geometry and fluid density and cla is a constant given by geometry and fluid viscosity. The flow or pressure between formation and annulus can have two states:

qf=0 (or close to 0) if the cleanup threshold pressure has not been exceeded and $\Delta pf = 0$ or approximately 0 if the cleanup threshold pressure has been exceeded and $\Delta pfc$ is the threshold pressure When assuming to different zones 1 and 2, each of them having homogenous properties within each zone and zone 1 being cleaned up and zone 2 not, the below equations describes to flow and pressure in the system. In this example, the following assumptions are made: no annular flow between the zones, and no pressure drop inside the tubing between the two zones.

q=q1 and q2=0

$$\Delta p = \Delta p1 = \Delta p2 = \Delta pr1 + \Delta pi1 = \Delta pf < \Delta pfc$$

By setting $\Delta p = \Delta p1 = \Delta p2 = \Delta pf = \Delta pfc$ the minimum required ICD pressure drop to clean up the filtercake can be calculated:

$$\Delta pi1 = \Delta pfc - \Delta pr1$$

This assumes no pressure drop or threshold pressure through a non flowing ICD. The drilling fluid commonly used when drilling a well has Bingham type properties, meaning that a certain differential pressure has to be exceeded to initiate flow. The pressure required to initiate a flow is proportional to the wetted area of a given flow channel divided by its cross section areas. This may result in a threshold pressure to initiate flow, particularly through narrow openings. This means a nozzle based ICD having short nozzles more in the shape of an orifice has a short length giving a very small wetted area. A tube/channel based ICD on the other hand has a much larger wetted area in the flow tube/channel which may result in a significant threshold pressure. The ICD is in most cases connected to a sand screen. The screen design itself may also add to this threshold pressure. As an example, a mesh type screen can have a fairly tortuous path through the filter media compared to a wire wrapped screen having a well defined slot opening more in the shape of an orifice. Further, the drainage layer under the screen section leading to the ICD housing should be designed with proper cross section area to reduce the threshold pressure to a minimum.

By determining the required pressure drop required to initiate the flow of the fluid system in the well through the ICD system and eventually also the connected screen, the total pressure drop can be determined. This pressure drop is the combination of the pressure drop across the formation to remove the filtercake and the pressure drop required to initiate the fluid flow through the ICD.

The design of the completion and the total flow rate has a significant impact on the pressure drop available to lift off the filter cake and break the circulation. In most cases the maximum flow rate is limited, thus the completion design must be optimized to achieve the desired cleanup over the whole completion interval.

The method to design the ICDs and thereby the method to cleanup the well is as follows:

(1) Determine the required pressure to lift off the filter cake. This can be done by performing laboratory tests on representative core plugs with the given fluid system from the well. A commonly used method is to apply a filter cake on the core plug and apply a pressure through the core plug towards the backside of the filtercake and measure the required pressure drop to initiate flow.

(2) Determine the required pressure to initiate flow through the ICD screen. This depends on the screen design. For a nozzle based ICD with wire wrapped screen and sufficient drainage area under the wrapping and into the ICD housing, the pressure required to initiate flow will in most cases be close to zero. For other designs, this threshold pressure can be significant. To determine this pressure, a flow test in the actual mud system may be carried out.

(3) Take benefit of the fact that the pressure drop through an ICD is small when fluid is not flowing through it and high when fluid is flowing. This means that zones or sections not cleaned-up will basically be exposed to the differential pressure from the formation into the tubing. The tubing pressure will be kept at a lower level due to the added pressure drop through the ICDs in the flowing zones.

(4) Calculate the ICD setting that will provide sufficient pressure drop in the flowing zones or sections to reduce the tubing pressure to a level whereby non cleaned up sections gets exposed to the required differential pressure. This ICD setting can be calculated based on the equation above ($\Delta pi1 = \Delta pfc - \Delta pr$). The ICD setting is directly associated with ct (nozzle or turbulent mode) or cla (tube/channel based ICD in laminar mode):

$$Ct1 = (\Delta pfc - cr1 \times q1)/q1\hat{}2$$

$$Cla1 = (\Delta pfc - cr1 \times q1)/q1$$

As can be seen from the nozzle or turbulent case, the denominator is squared with flow rate compared to the laminar case. This result in a relatively smaller pressure drop required through the ICDs along the well to achieve the cleanup.

The above calculations are based on simplified conditions. In a real well, the conditions are more complex and numerical models may be needed to solve the equations and determine the appropriate ICD setting. This may be done according to the work flow listed below.

(a) The well performance is estimated based on permeability data and fluid properties.

(b) This performance is compared with expected PI values to calibrate the model.

(c) The average flux is calculated to as a reference for the nozzle calculation.

(d) A proposed nozzle size (or ICD pressure drop setting) is calculated based on the expected well performance and the length of the productive completion interval.

(e) If the reservoir has similar properties along the whole length, the nozzle setting (or ICD setting) should normally be the same in all joints.

(f) If different reservoirs with different properties are penetrated, it might be beneficial to have different nozzle setting (or ICD setting) in the different zones.

(g) The combination of the ICD setting and the reservoir model with features to include the effect of filter cake removal and initiation of a Bingham type fluid flow should be run.

(h) The model should have an optimizer algorithm included or the model may be run repeatedly to optimize the result.

(i) The model may be run to optimize return on investment or optimized recovery of the reserves or somewhere between (5) ICDs may be used along the whole length of the completion to ensure that the whole completion interval can take benefit of the pressure regulating effect.

By use of the method outlined above, the minimum pressure drop setting for the ICDs can be calculated. If the calculations are associated with uncertainties, the pressure drop setting for the ICDs can be increased to accommodate for this uncertainty. Consequently, a method is available whereby the control of the flow path and the setting of the ICDs as flow dependent pressure drop elements can ensure that the required pressure drop is applied to the required locations on the wall of the well bore and to the completion itself to make it possible to achieve a proper well cleanup.

The design of the ICD and the connected screen can have a significant impact on the required pressure drop to initiate the flow. There are two main screen designs available to the market—(1) the surface type wire wrapped screens, and (2) the depth filter mesh screen (typically built up of a metal weave on a drainage layer and surrounded by a protective shroud). As the flow path becomes more tortuous, a higher pressure is required to break the shear strength of the fluid and initiate the flow of formation fluid. When using a tube/channel type ICD, a higher pressure drop is required to initiate the flow than by using a nozzle based ICD. This is due to the long and narrow flow channels. To break the circulation of a fluid that has a certain shear strength, a differential pressure proportional to the channel length and inverse proportional to the channel length is required. The use of a depth filter type screen will have the same effect. The tortuous path requires higher pressure to overcome the shear strength of the fluid. Additionally, a depth filter type screen may get packed with drill solids settled at the bottom of the well. This means that a wire wrapped screen with a drainage layer providing proper flow cross section area may be more beneficial.

Figure 4:
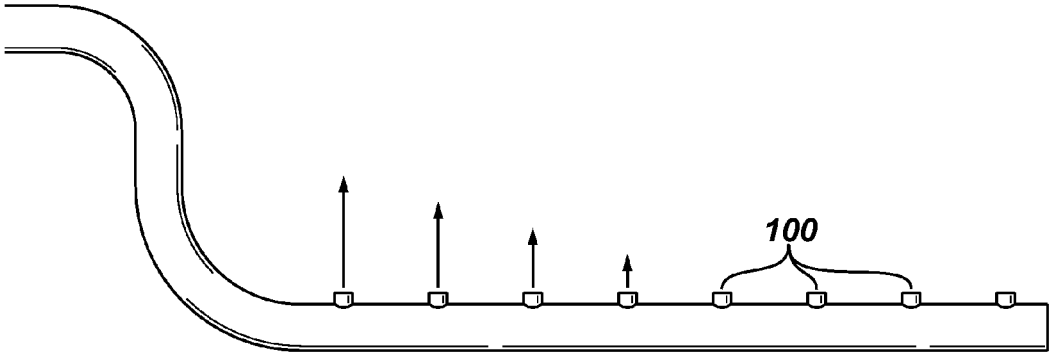
FIGS. 4 and 5 are schematic drawings intended to illustrate the physical principals underlying the embodiments described herein.
Figure 5:
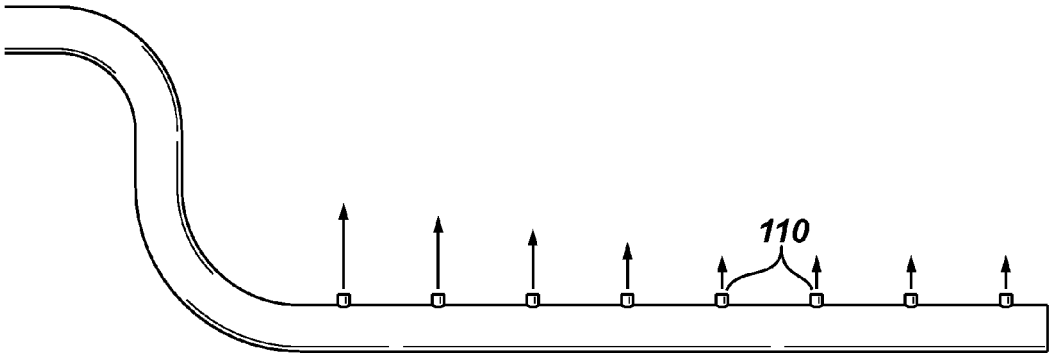

The effect of the limited pressure drop that can be applied in long horizontal well is illustrated in FIGS. 4 and 5. In FIG. 4, a pipe or tube has large holes 100 (e.g., standard sand screens) formed in a regular pattern. When fluid pressure is applied within the pipe or tube (e.g., drawdown pressure is applied to the well) the majority of the flow will exit the first holes near the inlet. By using smaller holes 110 (e.g., replacing the standard sand screens with ICDs) as illustrated in FIG. 5, the pressure drop across the holes (e.g., ICDs) becomes bigger and a larger fraction of the flow is forced further into the pipe.

As a further embodiment, it may be desirable, in an injector well, to initially put the wellbore into production (as outlined above) in order to clean up the filtercake. Once the desired amount of filtercake removal is effected, the well may then be used to inject liquid or gas into the formation.

Additionally, it may be desirable to run the ICD completion described herein with or without a sand screen associated with the completion.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method for preparing a wellbore for production comprising:

(a) positioning a completion longer than 300 m comprising an inflow control device (ICD) having a plurality of spaced radial flow paths in the wellbore adjacent to a filtercake;

(b) determining the pressure required to lift the filtercake off of the wellbore; and (c) maintaining a desired pressure drop profile along the completion by sizing the radial flow paths of the ICD;

wherein the radial flow paths of the ICD are designed such that when the filtercake adjacent to a downstream part of the completion is removed, the pressure drop across the downstream part of the completion is sufficient to maintain a drawdown pressure high enough such that the filtercake is also removed adjacent an upstream part of the completion.

2. The method of claim 1 wherein the ICD comprises nozzles.

3. The method of claim 1 wherein the ICD comprises a tube/channel type ICD.

4. The method of claim 1 further comprising a screen adjacent to the ICD.

5. The method of claim 4 wherein the screen is a wire-wrapped screen.

6. The method of claim 4 wherein the screen is a depth filter-type screen.

7. The method of claim 1 wherein the wellbore has at least one substantially horizontal portion and the filtercake is in the at least one substantially horizontal portion of the wellbore.

8. The method of claim 1 where the pressure drop through the ICDs is minimized while achieving the cleanup affect through a majority of the wellbore adjacent to the completion.

9. The method of claim 1 wherein the completion is devoid of a screen.

10. A method for preparing a wellbore for injection comprising:

(a) positioning a completion longer than 300 m comprising an inflow control device (ICD) having radial flow paths in the wellbore adjacent to a filtercake;

(b) determining the pressure required to lift the filtercake off of the wellbore;

(c) producing from the well until the wellbore is cleaned up while maintaining a desired pressure drop profile along the completion by sizing the radial flow paths of the ICD; and (d) injecting a liquid or gas into the formation adjacent to the completion;

wherein the radial flow paths of the ICD are designed such that when the filtercake adjacent to a downstream part of the completion is removed, the pressure drop across the downstream part of the completion is sufficient to maintain a drawdown pressure high enough such that the filtercake is also removed adjacent an upstream part of the completion.

11. The method of claim 10 wherein the ICD comprises nozzles.

12. The method of claim 10 wherein the ICD comprises a tube/channel type ICD.

13. The method of claim 10 wherein the wellbore has at least one substantially horizontal portion and the filtercake is in the at least one substantially horizontal portion of the wellbore.

14. The method of claim 10 where the pressure drop through the ICDs is minimized while achieving the cleanup effect through a majority of the wellbore adjacent to the completion.

* * * * *